US012674637B2

(12) United States Patent
Jackson

(10) Patent No.: US 12,674,637 B2
(45) Date of Patent: Jul. 7, 2026

(54) TRIGGER LOCK DEVICE

(71) Applicant: Harvey Jackson, Pearland, TX (US)

(72) Inventor: Harvey Jackson, Pearland, TX (US)

( * ) Notice: Subject to any disclaimer, the term of this patent is extended or adjusted under 35 U.S.C. 154(b) by 0 days.

(21) Appl. No.: 18/655,083

(22) Filed: May 3, 2024

(65) Prior Publication Data

US 2026/0177337 A1 Jun. 25, 2026

Related U.S. Application Data

(63) Continuation-in-part of application No. 18/085,951, filed on Dec. 21, 2022, now abandoned.

(51) Int. Cl.
*F41A 17/54* (2006.01)

(52) U.S. Cl.
CPC ..... *F41A 17/54* (2013.01)

(58) Field of Classification Search
CPC ..... F41A 17/54; F41A 17/46
USPC ..... 42/70.06–70.7, 70.01, 70.11
See application file for complete search history.

(56) References Cited

U.S. PATENT DOCUMENTS 9,488,428 B2 11/2016 Olivias
9,976,828 B2 * 5/2018 Pagac ..... F41A 17/54
10,775,122 B1 9/2020 Rofkahr et al.

OTHER PUBLICATIONS https://www.amazon.com/Garrison-Grip-Trigger-Holster-Revolver/dp/B013VO0XXA.

* cited by examiner

*Primary Examiner* — Reginald S Tillman, Jr.
(74) *Attorney, Agent, or Firm* — Jerome Drabiak; Michael Meyer; Edison Law Group

(57) ABSTRACT

A secure trigger lock for a firearm includes a solid body, an interior region formed within the solid body and adapted to accept a trigger of the firearm via an entrance formed to allow insertion of the trigger into the interior region of the solid body, the trigger when inserted into the interior region resting against an arcuate interior wall of the interior region of the solid body. A heavy jamb security device for a firearm is disclosed. The heavy jamb security device includes a pin lock; two legs coupled to the pin lock; a leg holder coupled to the heavy jamb security device; pin lock head tabs; and a guard rail nose configured to guide the two legs of the heavy jamb security device down to a bottom of the leg holder on either side of the leg holder.

5 Claims, 8 Drawing Sheets

TRIGGER LOCK DEVICE

CROSS-REFERENCE

This application is a continue-in-part application of a nonprovisional application application Ser. No. 18/085,951, filed on Dec. 21, 2022, of which entirety is incorporated by reference herein.

BACKGROUND OF THE DISCLOSURE

Technical Field

This disclosure relates to security devices for firearms. In particular, and without limitation, the disclosure relates to secure trigger locks for firearms.

Firearms safety devices are known in the art.

U.S. Pat. No. 9,488,428 describes a secondary safety device.

U.S. Pat. No. 10,775,122 describes a trigger energy absorption apparatus and method.

However, conventional firearms safety systems can be lost or inconvenient when needed in urgency.

The convenience of having no key and weapon can still fit in hoster/pocket with no problems is what makes this product more convenient then the original gun locksThey may require a key which can be lost and not available in an emergency situation requiring use of the firearm. Therefore, a need exists for such a secure trigger lock device as disclosed herein.

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

SUMMARY

In an aspect of the disclosure, a secure trigger lock device for a firearm is disclosed.

In an aspect of the disclosure, a method for using a secure trigger lock device with a firearm is disclosed.

In an aspect of the disclosure, a heavy jamb security device for a firearm is disclosed. The heavy jamb security device may include a pin lock positioned over an entrance to an interior region of the heavy jamb security device; two legs coupled to the pin lock and extending away from pin lock head tabs over the entrance to the interior region of the heavy jamb security device; a leg holder coupled to the heavy jamb security device and positioned to hold the two legs on either side of the leg holder; the pin lock head tabs coupled with a top surface of the pin lock; and a guard rail nose coupled with the two legs and configured to guide the two legs of the heavy jamb security device down to a bottom of the leg holder on either side of the leg holder.

Other systems, methods, features and advantages of the disclosure will be, or will become, apparent to one with skill in the art upon examination of the following figures and detailed description. It is intended that all such additional systems, methods, features and advantages be included within this description, be within the scope of the disclosure, and be protected by the following claims.

BRIEF DESCRIPTION OF THE DRAWINGS

The disclosure can be better understood with reference to the following drawings and description. The components in the figures are not necessarily to scale, emphasis instead being placed upon illustrating the principles of the disclosure. Moreover, in the figures, like referenced numerals designate corresponding parts throughout the different views.

DETAILED DESCRIPTION

Figure 1A:
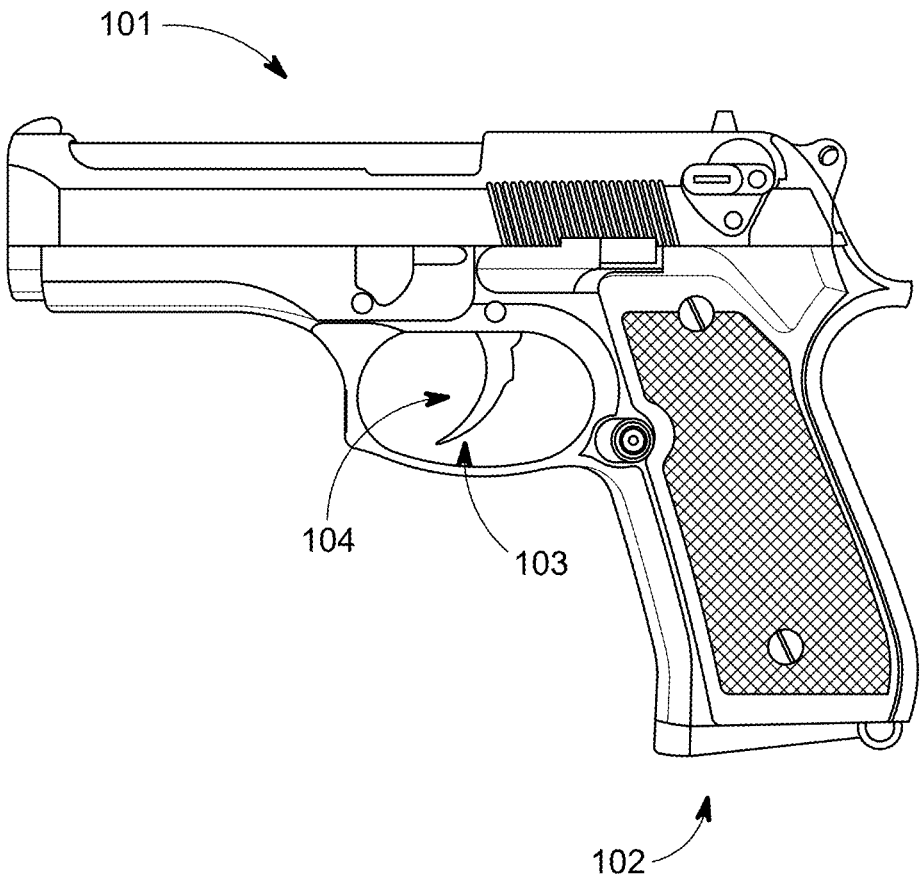
FIGS. 1*a*, 1*b* are example views of a firearm used in conjunction with the secure trigger lock device, according to the disclosure.

This application relates in general to a system and method for a secure trigger lock device for firearms.

Various embodiments of the present invention will be described in detail with reference to the drawings, wherein like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

In describing embodiments of the present invention, the following terminology will be used. The singular forms "a," "an," and "the" include plural referents unless the context clearly dictates otherwise. Thus, for example, reference to "a needle" includes reference to one or more of such needles and "etching" includes one or more of such steps. As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. As used herein, the singular forms "a," "an," and "the" are intended to include the plural forms as well, unless the context clearly indicates otherwise.

It further will be understood that the terms "comprises," "comprising," "includes," and "including" specify the presence of stated features, steps or components, but do not preclude the presence or addition of one or more other features, steps or components. It also should be noted that in some alternative implementations, the functions and acts noted may occur out of the order noted in the figures. For example, two figures shown in succession may in fact be executed substantially concurrently or may sometimes be executed in the reverse order, depending upon the functionality and acts involved.

As used herein, the term "about" means that dimensions, sizes, formulations, parameters, shapes, and other quantities and characteristics are not and need not be exact but may be approximated and/or larger or smaller, as desired, reflecting tolerances, conversion factors, rounding off, measurement error and the like, and other factors known to those of skill. Further, unless otherwise stated, the term "about" shall expressly include "exactly."

The disclosed trigger lock device is more convenient than conventional trigger locks and may help prevent accidental shootings by infant/kids and amateur users who happen to find themselves with a gun. If made into law, it would help police offers feel more at peace knowing the civilian weapon is temporarily disabled.

Figure 1B:
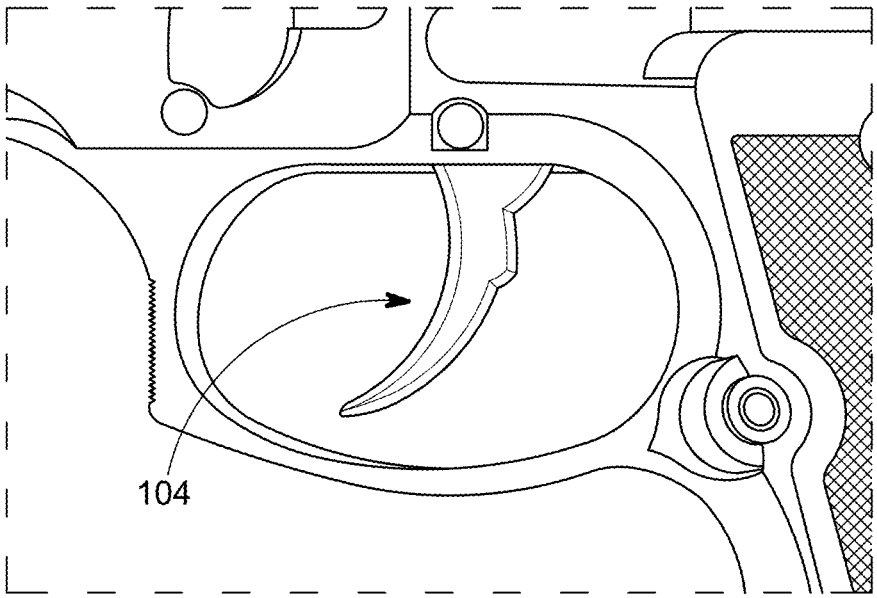

FIG. 1*a* and FIG. 1*b* are example views of a conventional firearm for use with the disclosed secure trigger lock device. In FIG. 1*a*, a conventional handgun firearm 101 is displayed. The firearm 101 includes a handle/grip 102 for the user to grasp with a hand. The firearm 101 includes an enclosed trigger region 103 into which a user inserts a finger to actuate the trigger 104, by placing a finger on the trigger 104 and depressing the trigger 104 towards a rear portion of the trigger 103 to discharge to firearm 101.

FIG. 1*b* is a magnified view of the firearm 101 shown in FIG. 1*a*. The trigger 104 is shown in magnification. The trigger 104 is typically a curved device configured to accept a finger upon it for when the user desires to pull the trigger 104 back and discharge the firearm 101. Typically, the components of the firearm 101 are composed of a durable metal. The handle/grip 102 may have a durable plastic or rubber layer to enhance grip of the firearm 101.

Figure 2:
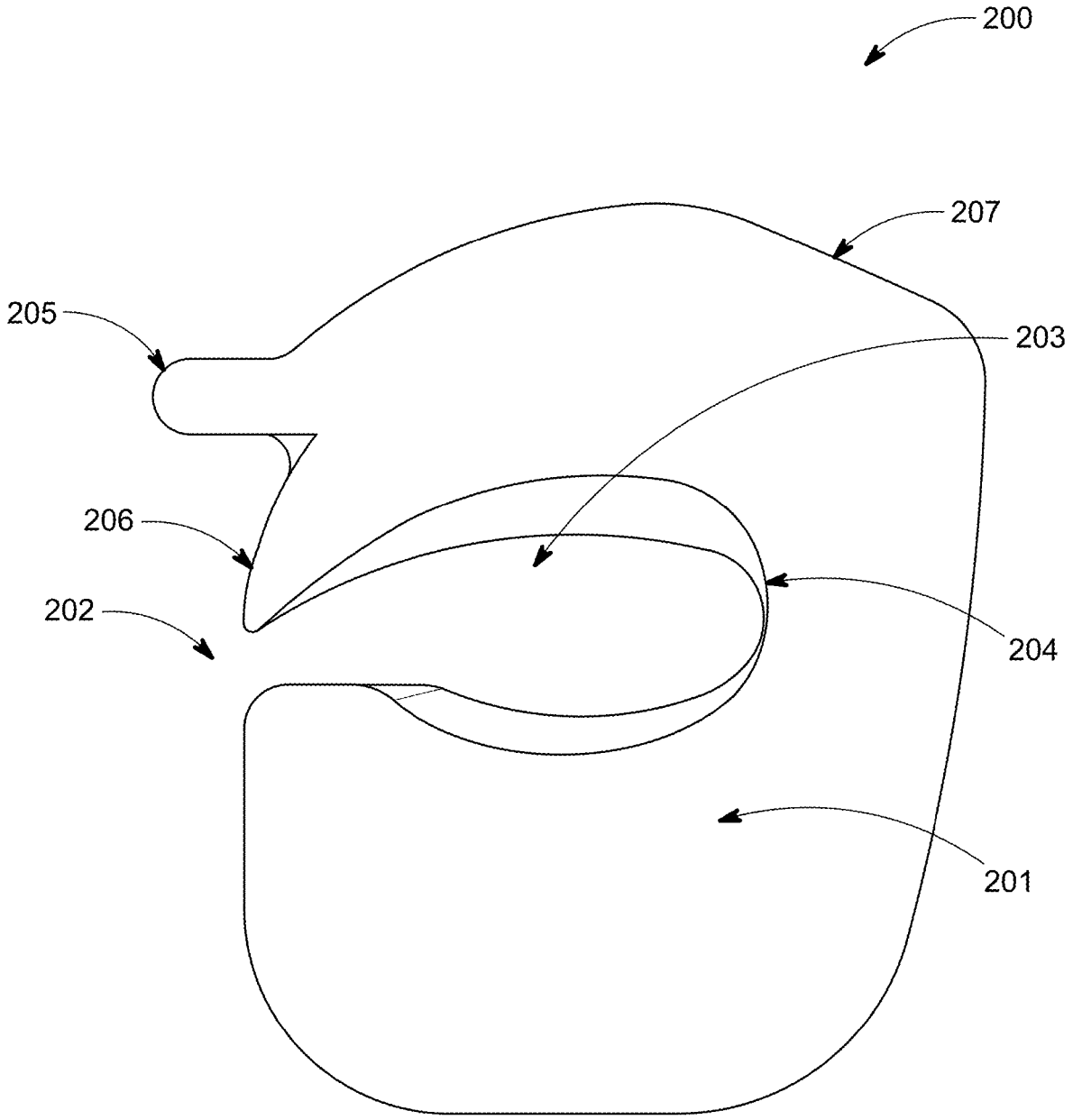
FIG. 2 is an example secure trigger lock device according to the disclosure.

FIG. 2 is an example perspective view of a secure trigger lock device 100 according to an aspect of the disclosure. Because a firearm can discharge lethal rounds of ammunition, sometimes accidentally or unintentionally, there is a need for a secure trigger lock device 200 to immobilize the trigger 104 from being depressed and discharging the firearm 101.

The secure trigger lock device 200 is a solid physical device, such as a small plastic item that fits around a firearm trigger 104 and which stops the firearm trigger 104 from moving. The secure trigger lock device 200 includes a solid central body 201. The central body 201 may be composed of a durable hard plastic or composite. In another aspect, the central body 201 may be composed of a durable foam, which may allow easier insertion and removal of the secure trigger lock device 200 into and out of the trigger region 103 and surrounding the trigger 104. The central body 201 may be symmetrical upon rotation.

The secure trigger lock device 200 includes an entrance 202 into an interior region 203. The interior region 203 is configured and molded to accept a trigger 104 for a particular firearm 101. The interior region 203 may be customized to fit the shape of a particular model of a firearm 101 or may be flexible to allow acceptance of more than one model and size of firearm 101. A trigger 104 may be inserted into the interior region 203 and may rest against a flexible interior arcuate wall 204.

The secure trigger lock device 200 may also include a tab 205 which is configured to allow a user to remove the secure trigger lock device 200 when the firearm 101 is needed for use. The secure trigger lock device 200 may include a lock notch 206 to grip the trigger 104 within the interior region 203 of the secure trigger lock device. The secure trigger lock device 200 may include a head 207 where a trigger finger may rest when the trigger finger is applied to the secure trigger lock device. The secure trigger lock device 200 may include an indent 208 proximate to the head 207, where a tip of the trigger finger may further rest when applied to the secure trigger lock device 200.

Figure 3A:
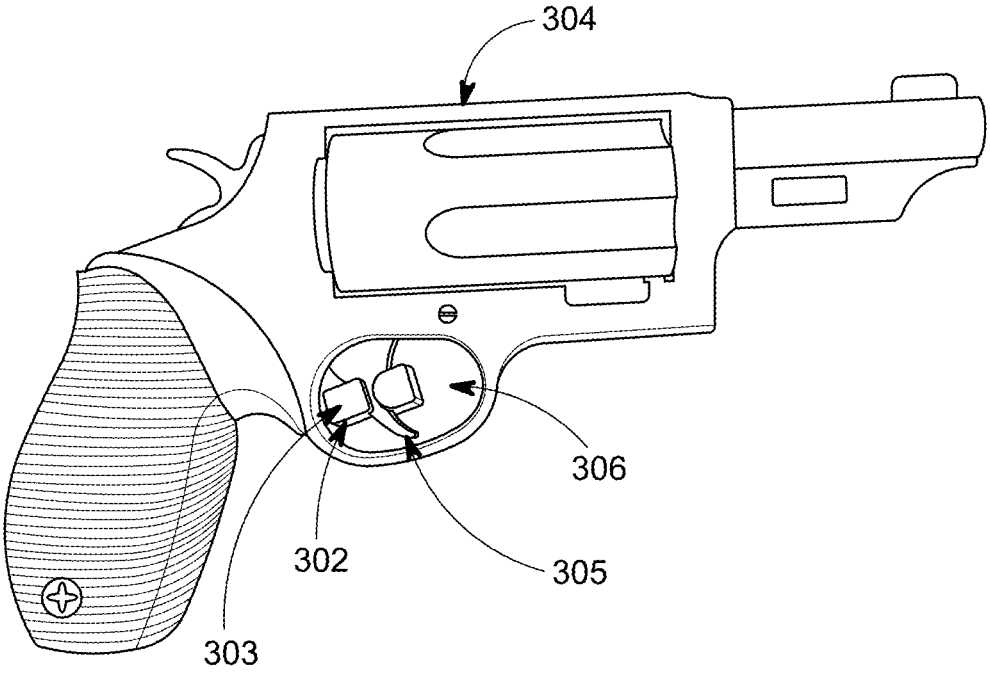
FIGS. 3*a*, 3*b* are side views of a secure trigger lock device attached to and secured to a firearm with a firearm trigger, according to an aspect of the disclosure

FIG. 3*a* is a side view of a secure trigger lock device 302 attached to and secured to a firearm 304 with a firearm trigger 305, according to an aspect of the disclosure. In an aspect of the disclosure, the secure trigger lock device 302 is a solid physical device, such as a small plastic item that fits around a firearm trigger 305 and which stops the firearm trigger 305 from moving. The secure trigger lock device 302 includes a solid central body 303. The solid central body 303 may be composed of a durable hard plastic or composite. In another aspect, the solid central body 303 may be composed of a durable foam, which may allow easier insertion and removal of the secure trigger lock device 302 into and out of the trigger region 306 and surrounding the firearm trigger 305. The solid central body 303 may be symmetrical upon rotation.

The secure trigger lock device 302 includes an interior region 307, where the interior region 307 is configured to surround the firearm trigger 305 for a particular firearm 304. The secure trigger lock device 302 may be of different sizes depending on a size of a firearm 304 for which the secure trigger lock device 302 is intended.

Figure 3B:
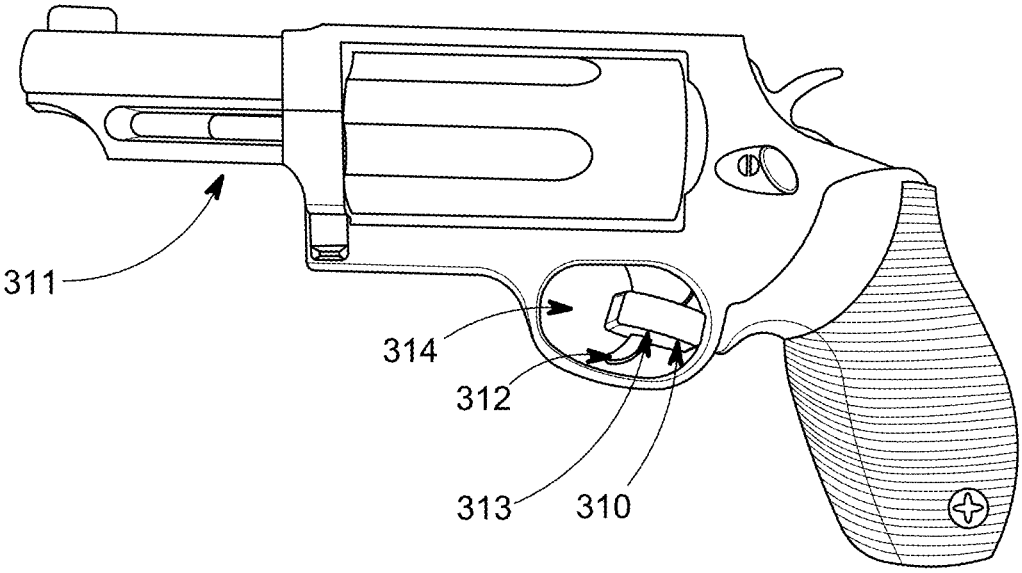

FIG. 3*b* is a reverse side view of FIG. 3*a*, including a secure trigger lock 310 attached to and secured to a firearm 311 with a firearm trigger 312, according to an aspect of the disclosure. In an aspect of the disclosure, the secure trigger lock device 310 is a solid physical device, such as a small plastic item that fits around a firearm trigger 312 and which stops the firearm trigger 312 from moving. The secure trigger lock device 310 includes a solid central body 313. The solid central body 313 may be composed of a durable hard plastic or composite. In another aspect, the solid central body 313 may be composed of a durable foam, which may allow easier insertion and removal of the secure trigger lock device 310 into and out of the trigger region 314 and surrounding the firearm trigger 312. The solid central body 313 may be symmetrical upon rotation.

Figure 4:
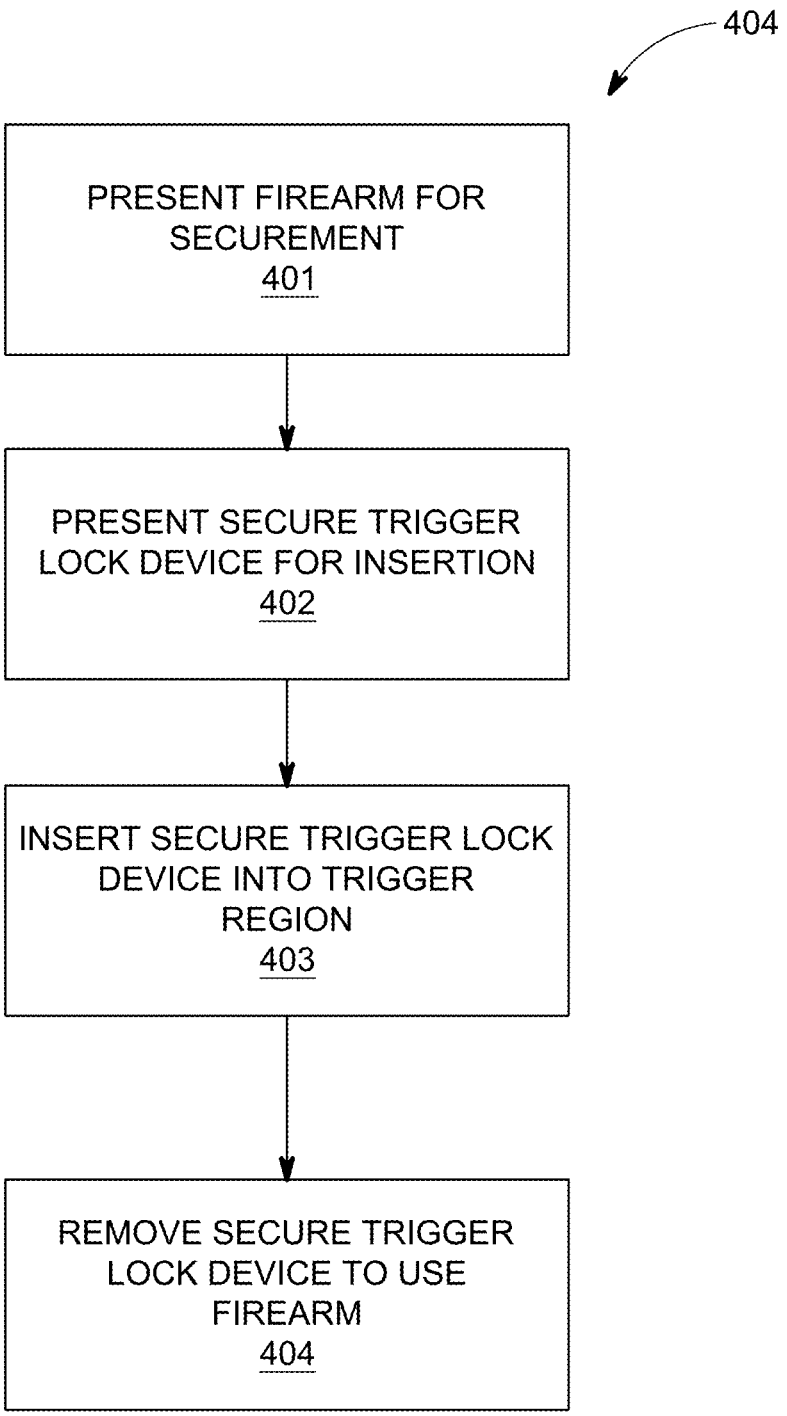
FIG. 4 is a flowchart for acts taken to use a secure trigger lock device with a firearm according to an aspect of the disclosure.

FIG. 4 is a flowchart 400 for acts taken to use a secure trigger lock device with a firearm according to an aspect of the disclosure.

In act 401, a firearm user presents a firearm 101, with trigger 104 in a relaxed, undepressed state for securement and protection from unintentional use.

In act 402, a secure trigger lock device 200 is presented for insertion into the trigger region 103. The secure trigger lock 200 may be specifically designed and adapted to accept the trigger 104 of the firearm 101 or may be flexible to accommodate different firearm models and designs.

In act 403, the secure trigger lock device 200 is inserted into the trigger region 103 of the firearm 101. The secure trigger lock 200 is positioned around and surrounding the trigger 104 in at least one plane of the firearm 101 to prevent motion of the trigger 104 when the firearm 101 is not needed or stored, to prevent accidental discharge. On the secure trigger lock device 200, a lock notch 206 may assist in maintaining the secure trigger lock device 200 positioned against a flexible interior arcuate wall 204. In this state, the firearm trigger 104 is immobilized.

In act 404, the user may remove the secure trigger lock device 200 from around the trigger 104 to allow use of the firearm 101. In an aspect, the user may take advantage of a tab 205 to allow easier removal of the secure trigger lock device 200.

The secure trigger lock device 200 may be an article of manufacture from a process adapted to create plastic, foam or other durable but flexible materials into a solid body for the secure trigger lock device 200. In an aspect, the process to manufacture the secure trigger lock device 200 may employ additive manufacturing, injection molding, stereolithography or other processes known to one of skill in the art. The manufacturing of the secure trigger lock device 200 may involve custom sizing of the solid body 201, the interior region 203, the flexible interior arcuate wall 204, the tab 205 and/or the lock notch 206.

Figure 5A:
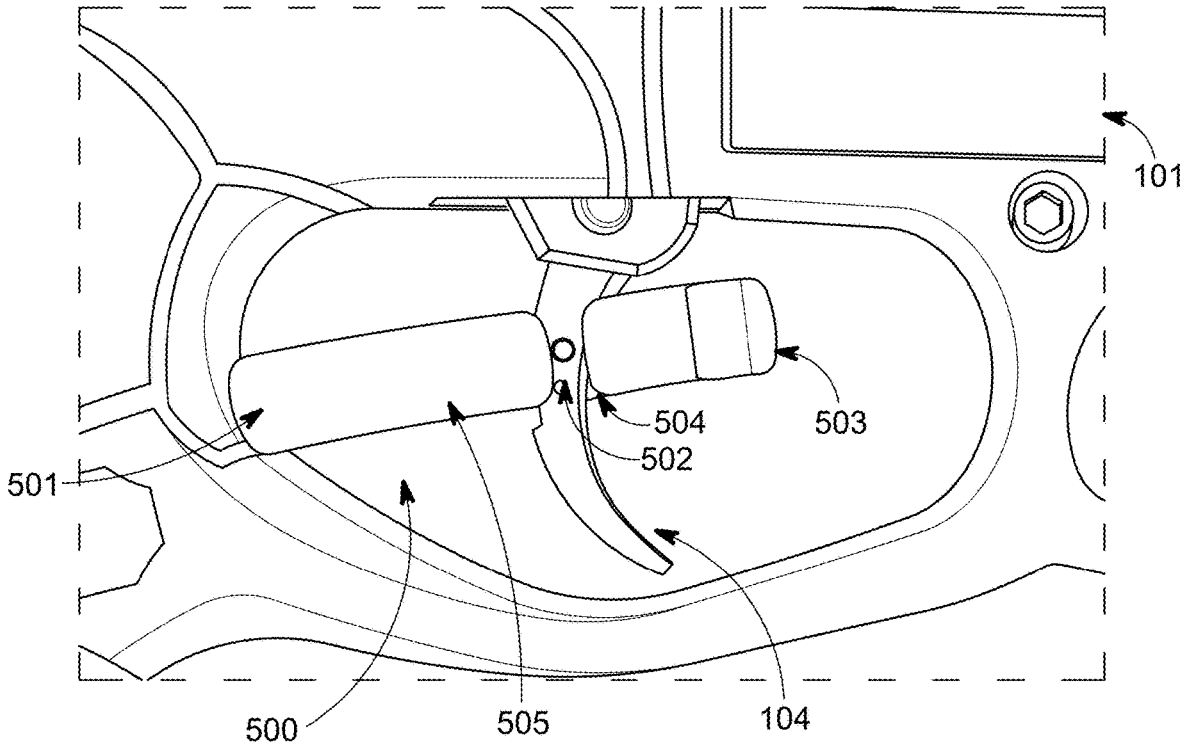
FIG. 5A is an example secure trigger lock device in use with a firearm according to an aspect of the disclosure.

FIG. 5A is an example secure trigger lock device 500 in use with a firearm 101 according to an aspect of the disclosure. In an aspect, a firearm 101 includes a trigger 104, as described above and as known to one of skill in the art. An exemplary secure trigger lock device 500 may include a base 501 that may function to jamb the trigger 104. The secure trigger lock device 500 may include a mouth 502 into with the trigger 104 is inserted to be contained within the secure trigger lock device 500. The secure trigger lock device 500 may include a head 503, where a trigger finger of a person may rest when using the secure trigger lock device 500. In an aspect, the secure trigger lock device 500 may include a tooth 504 which may serve to latch onto the trigger 104 to hold it in place within the secure trigger lock device 500. In an aspect, the secure trigger lock device 500 may include a bottom stopper 505 that fits between the trigger 104 and the trigger guard of the firearm 101.

Figure 5B:
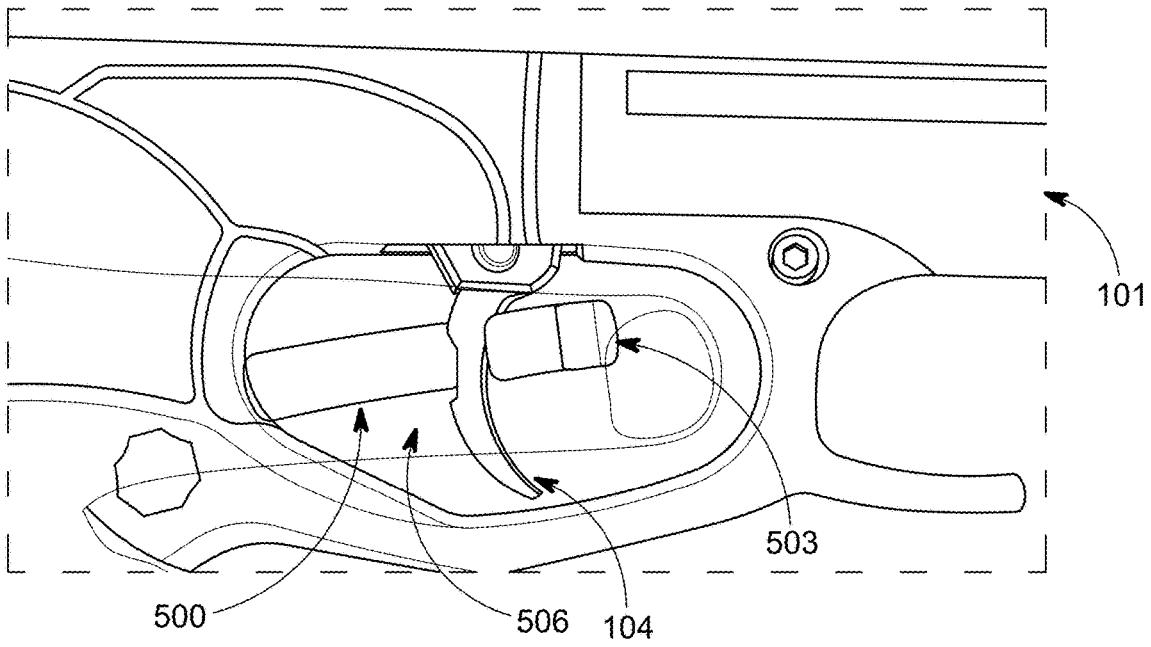
FIG. 5B is another example secure trigger lock device in use with a firearm according to an aspect of the disclosure.

FIG. 5B is another example secure trigger lock device in use with a firearm according to an aspect of the disclosure. In this aspect, the firearm 101 with trigger 104 includes a head 503 where a user's trigger finger 506 (shown in silhouette here) may rest when gripping the firearm 101.

Figure 6:
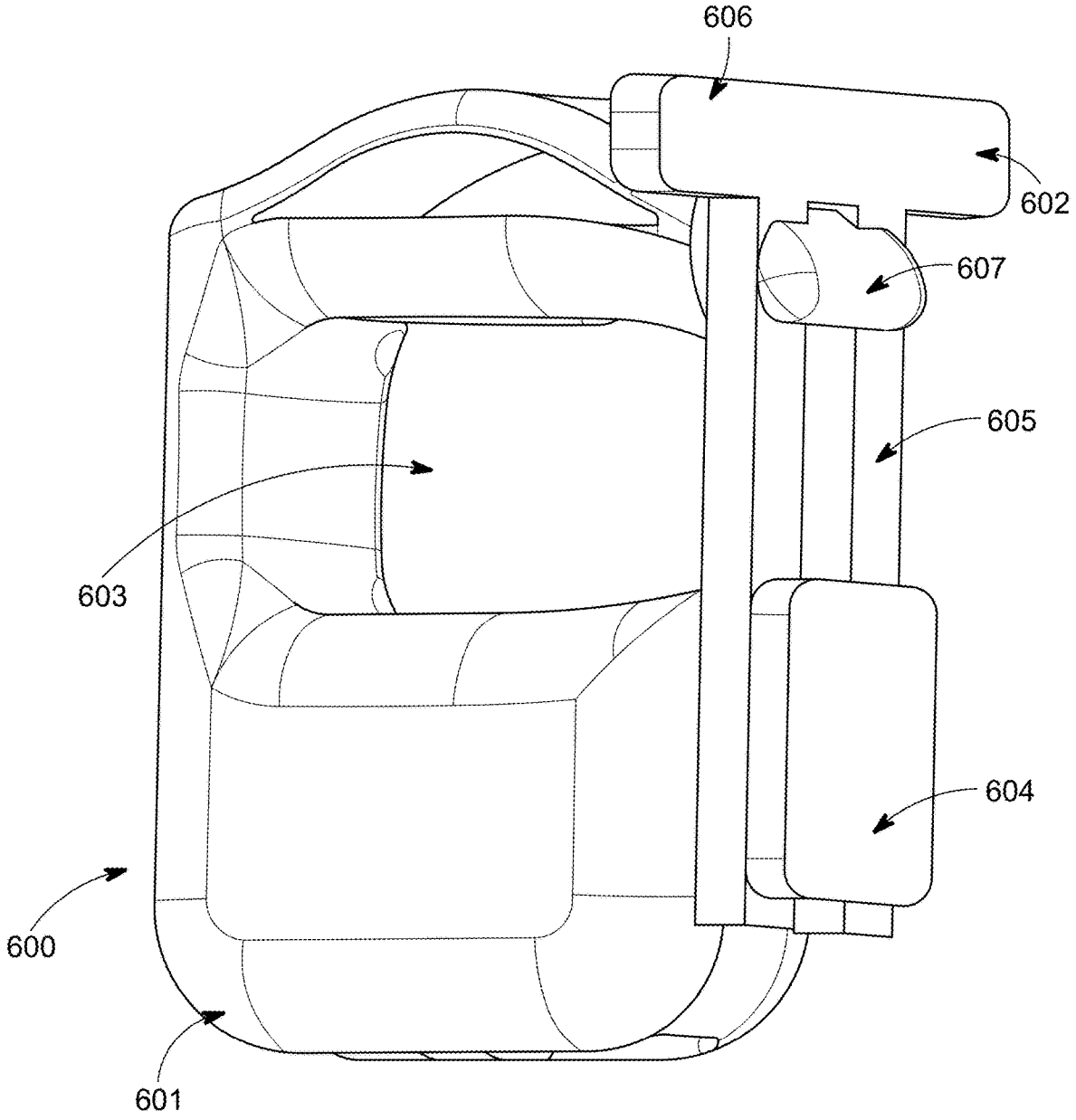
FIG. 6 is an example heavy jamb security device according to an aspect of the disclosure.

FIG. 6 is an example heavy jamb security device 600 according to an aspect of the disclosure. The heavy jamb security device 600 may be used to further secure a firearm 101. The heavy jamb security device 600 may include a jamb body 601. In an aspect, heavy jamb security device 600 may include a pin lock 602, coupled with the jamb body 601. In an aspect, the pin lock 601 is positioned over an entrance to an interior region 602 of the heavy jamb security device 600. The pin lock 602 is used to lock the trigger 104 (not shown) of the firearm 101 in place.

In an aspect, the heavy jamb security device 600 may include a leg holder 604 coupled to the heavy jamb security device 600.

In an aspect, the heavy jamb security device 600 may include pin lock head tabs 606 coupled with a top surface of the pin lock 602. The pin lock head tabs 606 may be placed to be gripped by the user's fingers to install and remove the heavy jamb security device 600.

In an aspect, the heavy jamb security device 600 may include two legs 605 coupled to the pin lock 602. The two legs 605 are coupled to the pin lock 602 and extending away from the pin lock head tabs 606 over the entrance to the interior region 603 of the heavy jamb security device 600. The two legs 605 may be used to slide down past and on both sides of the leg holder 604 and keep the trigger 104 confined within the heavy jamb security device 600. The leg holder 604 may be a slot configured to hold the two legs 605 of the pin lock 602 to ensure the jamb body 601 does not come off.

In an aspect, the heavy jamb security device 600 may include a guard rail nose 607 coupled with the two legs 605. The guard rail nose 607 may be used to guide the two legs 604 of the heavy jamb security device 600 down to the bottom of the leg holder 604 on either side of the leg holder 604.

Figure 7:
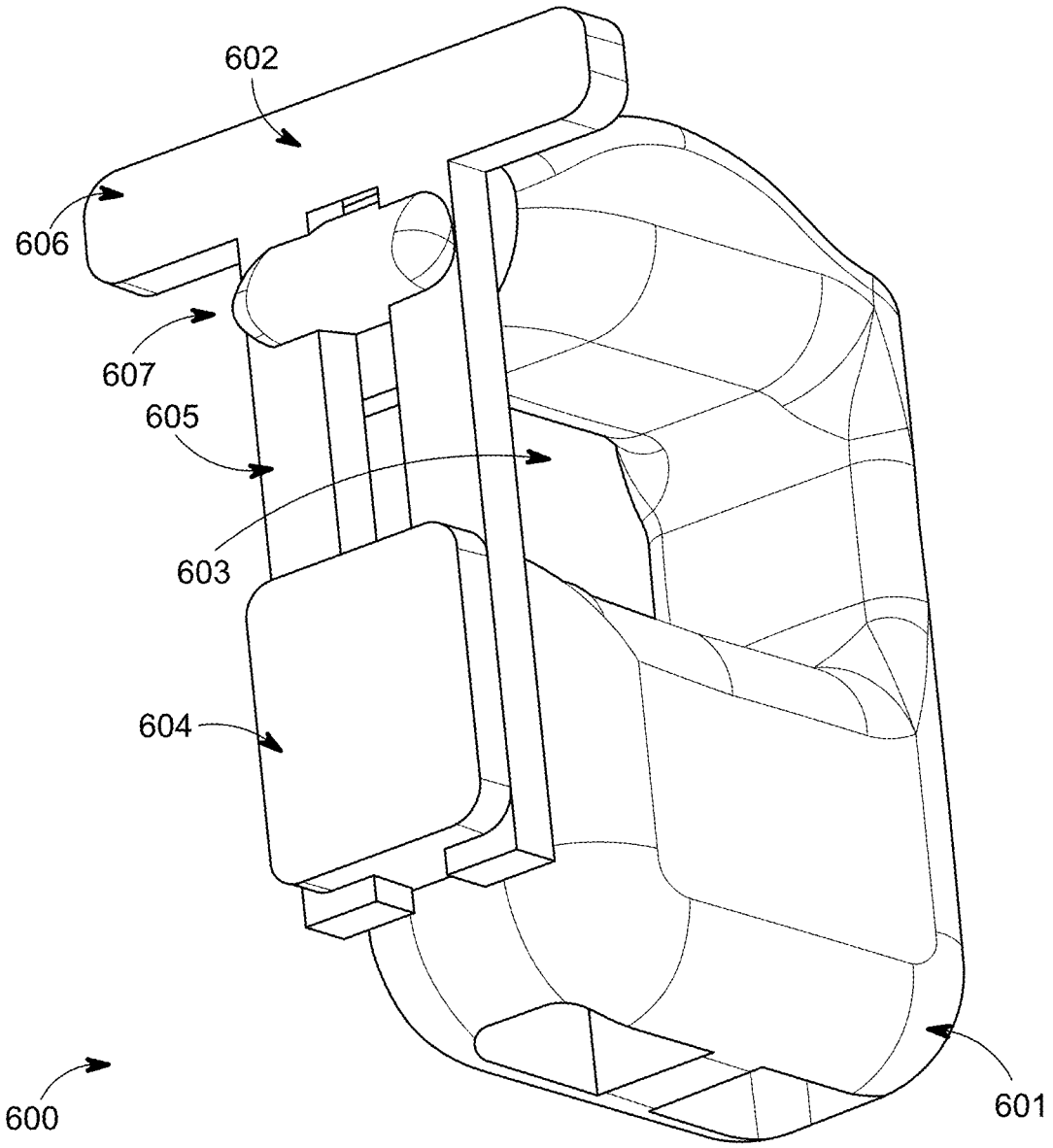
FIG. 7 is perspective view of an example heavy jamb security device according to an aspect of the disclosure.

FIG. 7 is perspective view of an example heavy jamb security device 600 according to an aspect of the disclosure. In FIG. 7, the heavy jamb security device 600 is viewed from a reversed perspective compared to the perspective in FIG. 6. The reference numerals in FIG. 7 correspond to those of FIG. 6 respectively.

Figure 8:
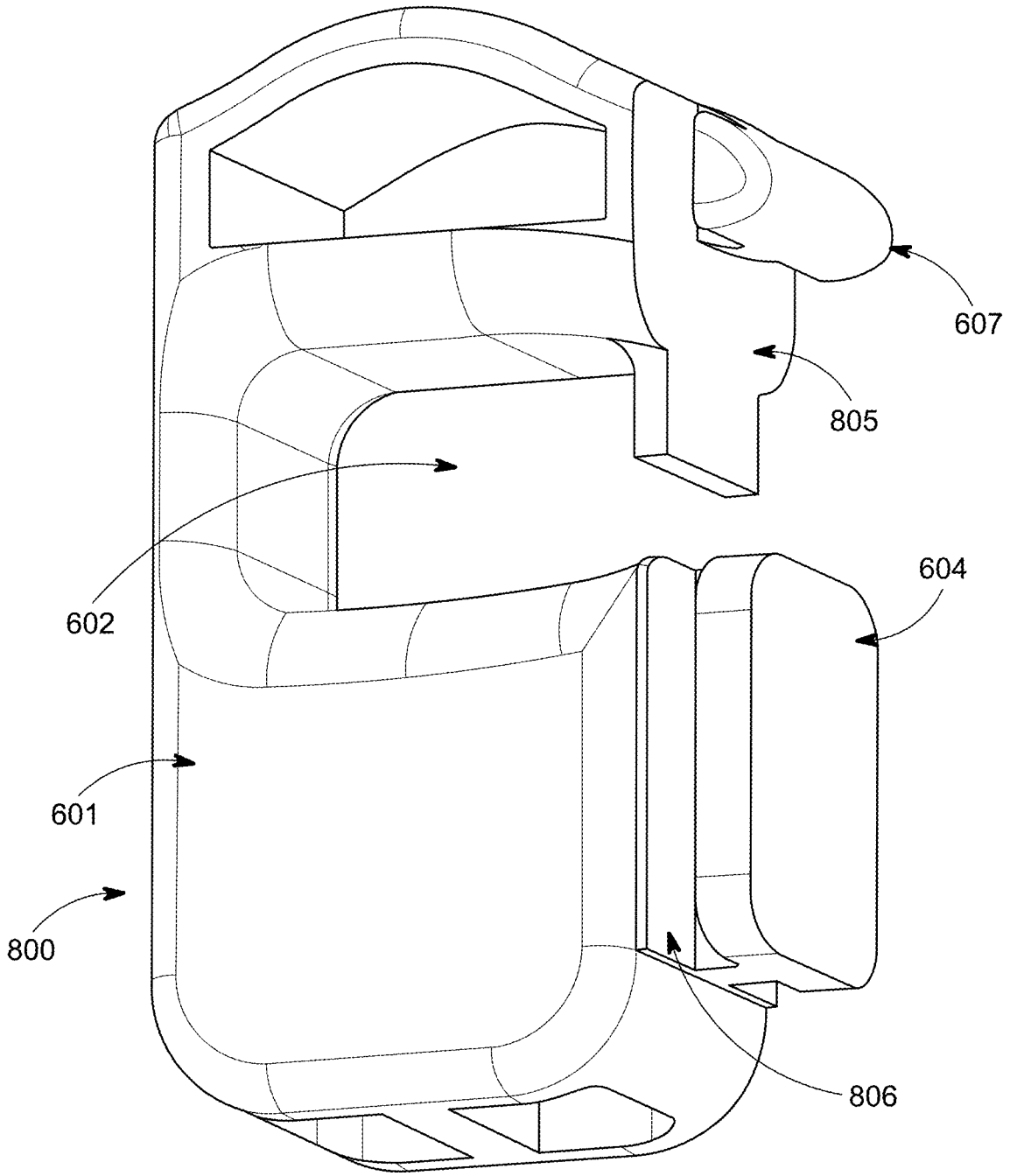
FIG. 8 is an example view of a heavy jamb security device according to an aspect of the disclosure.

FIG. 8 is an example view of a heavy jamb security device 800 according to an aspect of the disclosure. FIG. 8 is an example view of the heavy jamb security device 600 with the pin lock 602, the leg holder 604, the two legs 605 and the pin lock head tabs 606 absent to view. In an aspect, the heavy jamb security device 800 may include a leg placement surface 805 upon which the two legs 605 rest when present in the heavy jamb security device 600. The heavy jamb security device 800 may include a leg placement surface 806, upon which the two legs 605 rest between the leg placement surface 806 and the leg holder 604 when the two legs 605 are present.

In an aspect, the heavy jamb security device 600 may be used with the firearm 101 in either vertical direction within the interior region of the firearm 101 where the trigger 104 is located. That is, the heavy jamb security device 600 may oriented as shown in FIG. 5 or inverted.

In an aspect, the heavy jamb security device 600 may be an article of manufacture from a process adapted to create plastic, foam or other durable but flexible materials into a solid body for the heavy jamb security device 500. In an aspect, the process to manufacture heavy jamb security device 500 may employ additive manufacturing, injection molding, stereolithography or other processes known to one of skill in the art. The manufacturing of the heavy jamb security device 500 may involve custom sizing of the pin lock 501, the interior region 502, the leg holder 503, the two legs 504, the pin lock head tabs 505 and the guard rail nose 506. In an aspect, the heavy jamb security device 600 may be made of durable foam or rubber to which such material allows for slight movement (which is needed to release the tooth from the trigger) to remove the security device. In an aspect, the dimensions of the heavy jamb security device 600 and pin-lock may be around 1"×¾".

In an aspect of the disclosure, the heavy jamb security device 600 may be double sided with different measurements for each side. With different measurements for each side, the heavy jamb security device 600 may fit more or multiple triggers and guns. This is achieved by turning the security device upside down, and installing it, by sliding it on the trigger, the same way as it would be if it was positioned right side up.

While various aspects of the disclosure have been described, it will be apparent to those of ordinary skill in the art that many more aspects and implementations are possible within the scope of the disclosure. Accordingly, the disclosure is not to be restricted except in light of the attached claims and their equivalents.

What is claimed is:

1. A secure trigger lock device for a firearm, comprising:

a flexible solid body;

an interior region formed within the solid body and adapted to accept a trigger of the firearm via an entrance formed to allow insertion of the trigger into the interior region of the flexible solid body, the trigger when inserted into the interior region resting against a flexible arcuate interior wall of the interior region of the flexible solid body; and a tab positioned upon the solid body of the secure trigger lock device and proximate to the entrance to the interior region, the tab configured to accept a finger of the user to allow release of the secure trigger lock device, and where the flexible solid body is configured for positioning in more than one orientation within an interior trigger region of the firearm to allow insertion of the trigger into the interior region of the flexible solid body.

2. The secure trigger lock device of claim 1, further comprising a lock notch positioned upon the flexible solid body of the secure trigger lock device and proximate to the entrance to the interior region, where the lock notch is configured to secure the trigger when inserted into the interior region of the flexible solid body.

3. The secure trigger lock device of claim 1, where the secure trigger lock device comprises a durable, flexible foam material.

4. The secure trigger lock device of claim 1, where the secure trigger lock device comprises a durable, flexible plastic material.

5. The secure trigger lock device of claim 1, where the interior region of the secure trigger lock device is adaptable to different sizes of the trigger.

* * * * *